US009371807B2

(12) United States Patent
Kronberger et al.

(10) Patent No.: US 9,371,807 B2
(45) Date of Patent: Jun. 21, 2016

(54) METHOD AND DEVICE FOR SETTING AN IDLE STROKE OF AN ACTUATING DRIVE OF AN INJECTION VALVE, AND INJECTOR ASSEMBLY

(75) Inventors: Maximilian Kronberger, Steyr (AT); Hellmut Freudenberg, Pentling/Grossberg (DE); Robert Schäpers, Langquaid (DE); Matthias Wicke, Wernberg-Köblitz (DE); Stefan Mindl, Neukirchen (DE); Wolfgang Wechler, Regensburg (DE)

(73) Assignee: CONTINENTAL AUTOMOTIVE GMBH, Hannover (DE)

( * ) Notice: Subject to any disclaimer, the term of this patent is extended or adjusted under 35 U.S.C. 154(b) by 168 days.

(21) Appl. No.: 13/820,725

(22) PCT Filed: Aug. 18, 2011

(86) PCT No.: PCT/EP2011/064220

§ 371 (c)(1),
(2), (4) Date: Mar. 4, 2013

(87) PCT Pub. No.: WO2012/028464

PCT Pub. Date: Mar. 8, 2012

(65) Prior Publication Data

US 2013/0153675 A1 Jun. 20, 2013

(30) Foreign Application Priority Data

Sep. 3, 2010 (DE) ..... 10 2010 044 285

(51) Int. Cl.

| | |
|---|---|
| ***F02D 1/06*** | (2006.01) |
| ***F02M 61/16*** | (2006.01) |
| ***F02M 63/00*** | (2006.01) |
| *F02M 51/06* | (2006.01) |

(52) U.S. Cl.

CPC ..... *F02M 61/16* (2013.01); *F02M 61/168* (2013.01); *F02M 63/0026* (2013.01);

(Continued)

(58) Field of Classification Search

None

See application file for complete search history.

(56) References Cited

U.S. PATENT DOCUMENTS 4,516,729 A * 5/1985 Fussner et al. ..... 239/453
6,705,587 B1 * 3/2004 Frank et al. ..... 251/129.06

(Continued)

FOREIGN PATENT DOCUMENTS

DE 102005015409 A1 10/2006 ..... B23P 19/00
DE 102009018289.6 * 10/2009

(Continued)

OTHER PUBLICATIONS

International Search Report, International Application No. PCT/EP2011/064220, 2 pages, Nov. 22, 2011.

*Primary Examiner* — Len Tran
*Assistant Examiner* — Adam J Rogers
(74) *Attorney, Agent, or Firm* — Slayden Grubert Beard PLLC

(57) ABSTRACT

A method and a device for setting an idle stroke of an actuating drive of an injection valve with respect to an actuating element actuated by the actuating drive. The actuating drive is arranged in an injector body and the actuating element is arranged in an actuating-element housing such that it is movable in an axial. An axial stressing force is applied to the injector body and the actuating-element housing such that part of the injector body or actuating-element housing arranged in a force flow path defined the axial stressing force is deformed permanently, until a value of a representative electric variable determined directly or indirectly for the idle stroke of the actuating drive lies in a predefined value range. Further, an injector assembly for an injection valve may include an injector body and/or an actuating-element housing having a contact section elevated in the axial direction.

7 Claims, 4 Drawing Sheets

(52) U.S. Cl.
CPC ..... *F02M 51/0603* (2013.01); *F02M 2200/701* (2013.01); *F02M 2200/8053* (2013.01); *F02M 2200/8092* (2013.01)

(56) References Cited

U.S. PATENT DOCUMENTS

| | | | | |
|---|---|---|---|---|
| 2008/0011972 | A1 | 1/2008 | Frank et al. | F02M 47/02 47/2 |
| 2012/0031378 | A1 * | 2/2012 | Brandt | 123/490 |
| 2014/0346244 | A1 * | 11/2014 | Russe et al. | 239/4 |

FOREIGN PATENT DOCUMENTS

| | | | | |
|---|---|---|---|---|
| EP | 1103718 | A2 | 5/2001 | F02M 47/02 |
| WO | WO 2008129008 | A2 * | 10/2008 | |
| WO | WO 2010012189 | A1 * | 10/2010 | |
| WO | 2012/028464 | A1 | 3/2012 | F02M 51/06 |
| WO | WO 2012028464 | A1 * | 3/2012 | |

* cited by examiner

METHOD AND DEVICE FOR SETTING AN IDLE STROKE OF AN ACTUATING DRIVE OF AN INJECTION VALVE, AND INJECTOR ASSEMBLY

CROSS-REFERENCE TO RELATED APPLICATIONS

This application is a U.S. National Stage Application of International Application No. PCT/EP2011/064220 filed Aug. 18, 2011, which designates the United States of America, and claims priority to DE Application No. 10 2010 044 285 .2 filed Sep. 3, 2010, the contents of which are hereby incorporated by reference in their entirety.

TECHNICAL FIELD

The disclosure relates to a method and to a corresponding device for setting an idle stroke of an actuating drive of an injection valve in relation to a control element which can be actuated by the actuating drive, and to an injector assembly.

BACKGROUND

Ever stricter legal requirements with respect to the permissible pollutant emissions from internal combustion engines arranged in motor vehicles make it necessary to perform various measures to lower pollutant emissions. The formation of pollutants is heavily dependent on the preparation of the air/fuel mixture in the particular cylinder of the internal combustion engine. Correspondingly improved mixture preparation can be achieved if the fuel is metered in at very high pressure. For diesel internal combustion engines, the fluid pressures are over 2000 bar. In the case of internal combustion engines, in particular, demanding requirements are made on the precision of the injector assembly.

SUMMARY

One embodiment provides a method for setting an idle stroke of an actuating drive of an injection valve in relation to a control element which can be actuated by the actuating drive, wherein the actuating drive is arranged in an injector body and the control element is arranged in a control-element housing in such a way that it can be moved in the direction of a longitudinal axis, and the injector body and the control-element housing are arranged in the axial direction with respect to one another, wherein an axial clamping force is applied to the injector body and the control-element housing, such that a part of the injector body or a part of the control-element housing which is arranged in a force flow path, formed by the axial clamping force, in the injector body and the control-element housing is permanently deformed, until a value of a representative electric variable which is determined directly or indirectly for the idle stroke of the actuating drive is in a predetermined range of values.

In a further embodiment, the electric variable representative of the idle stroke of the actuating drive is representative of a closing time of the injection valve.

In a further embodiment, the axial clamping force on the injector body and the control-element housing is applied at least in part by means of a clamping device formed separately from the injection valve.

In a further embodiment, an axial clamping force with a predetermined first value is applied to the injector body and the control-element housing by means of the clamping device separate from the injection valve, a further axial clamping force with a predetermined value is applied to the injector body and to the control-element housing by means of a clamping element of the injection valve, a base value of the electric variable representative of the idle stroke of the actuating drive is determined, a second value of the axial clamping force of the clamping device, which is dependent on the base value determined, is determined, the axial clamping force of the clamping device with the second value determined is applied to the injector body and the control-element housing, and the axial clamping force of the clamping element on the injector body and the control-element housing is varied until the value of the electric variable representative of the idle stroke of the actuating drive is in the predetermined range of values.

In a further embodiment, after the axial clamping force of the clamping device with the second value determined is applied to the injector body and the control-element housing, the axial clamping force of the clamping element on the injector body and the control-element housing is first of all varied until the value of the electric variable representative of the idle stroke of the actuating drive is in a predetermined limiting range outside the predetermined range of values, and the axial clamping force of the clamping device with the second value determined is then applied to the injector body and the control-element housing until the value of the electric variable representative of the idle stroke of the actuating drive is in the predetermined range of values, and the injector body and the control-element housing are then relieved completely of the axial clamping force of the clamping device separate from the injection valve.

In a further embodiment, the actuating drive is pre-calibrated by determining a dependence of a stroke of the actuating drive on a characteristic electric signal of the actuating drive, and the range of values of the electric variable representative of the idle stroke of the actuating drive is determined as a function of the stroke of the actuating drive.

In a further embodiment, a radial supporting force with a predetermined value is applied to the injector body and/or the control-element housing together with the axial clamping force of the clamping device separate from the injection valve, a first value of the electric variable representative of the idle stroke of the actuating drive is determined, the injector body and/or the control-element housing is/are relieved of the axial clamping force and the radial supporting force, a second value of the electric variable representative of the idle stroke of the actuating drive is determined, the range of values of the electric variable representative of the idle stroke of the actuating drive is determined as a function of the first value and of the second value, the axial clamping force of the clamping device separate from the injection valve and the radial supporting force with the value are applied to the injector body and/or the control-element housing, and the axial clamping force of the clamping element on the injector body and the control-element housing is varied until the value of the electric variable representative of the idle stroke of the actuating drive is in the predetermined range of values.

Another embodiment provides a device for setting an idle stroke of an actuating drive of an injection valve in relation to a control element which can be actuated by the actuating drive, wherein the actuating drive is arranged in an injector body and the control element is arranged in a control-element housing in such a way that it can be moved in the direction of a longitudinal axis, and the injector body and the control-element housing are arranged in the axial direction with respect to one another, wherein the device is designed to apply an axial clamping force to the injector body and the control-element housing, such that a part of the injector body or a part of the control-element housing which is arranged in a force flow path, formed by the axial clamping force, in the injector body and the control-element housing is permanently deformed, until a value of a representative electric variable which is determined directly or indirectly for the idle stroke of the actuating drive is in a predetermined range of values.

Another embodiment provides an injector assembly for an injection valve, having an injector body, which has an injector-body recess in which an actuating drive is arranged, a control-element housing, which has a recess in which a control element is arranged in such a way that it can be moved in the direction of a longitudinal axis, such that a fluid flow through at least one injection opening is prevented in a closed position of the control element and, otherwise, a fluid flow through the at least one injection opening is allowed, and the injector body and the control-element housing are arranged in the axial direction with respect to one another, wherein the injector body and/or the control-element housing have/has a contact section which is elevated in the axial direction.

In a further embodiment, the contact section is designed as at least one biting edge.

In a further embodiment, the contact section is of annular design.

BRIEF DESCRIPTION OF THE DRAWINGS

Exemplary embodiments will be explained in more detail below based on the schematic drawings, wherein.

DETAILED DESCRIPTION

Figure 1:
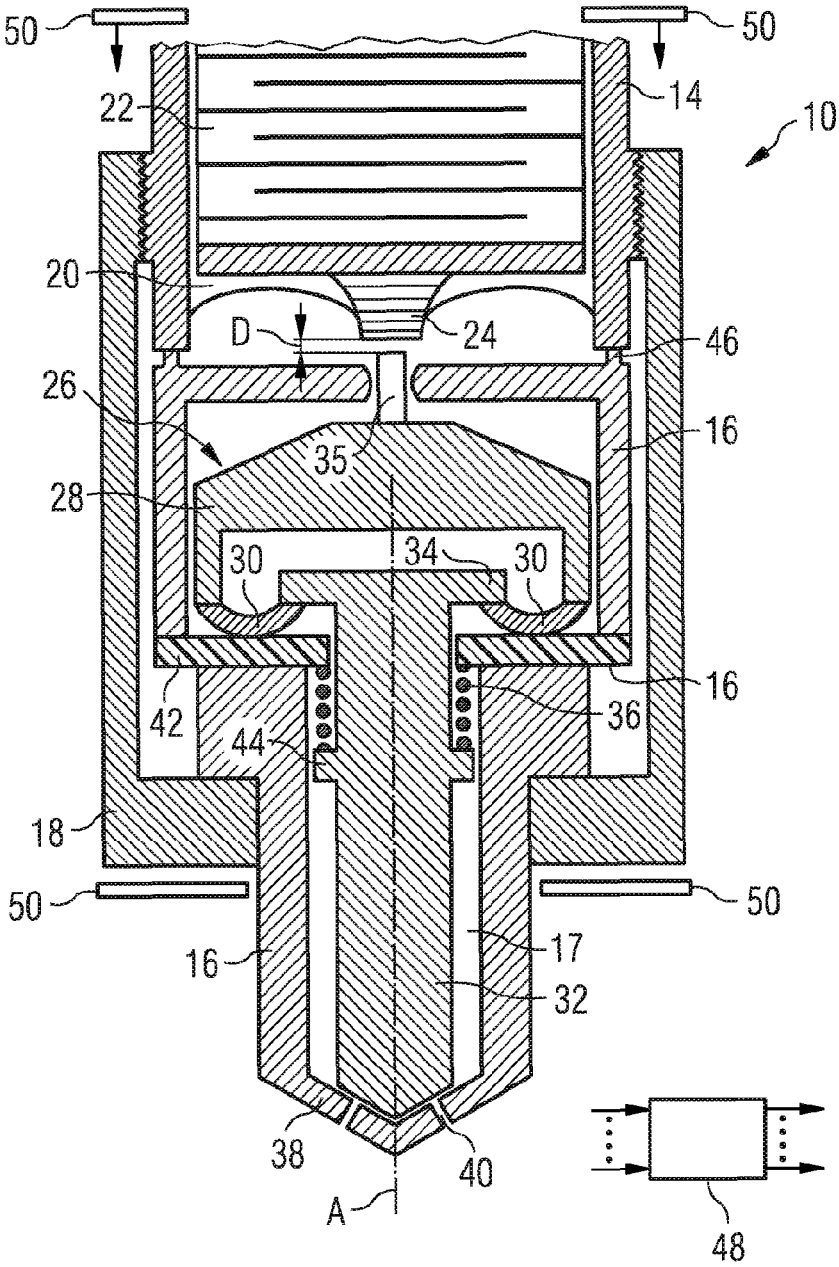
FIG. 1 shows an injection valve in longitudinal section.

Embodiments of the present disclosure provide a method and a corresponding device for setting an idle stroke of an actuating drive of an injection valve and an injector assembly which allow reliable operation of the injection valve.

For example, some embodiments provide a method and a corresponding device for setting an idle stroke of an actuating drive of an injection valve in relation to a control element which can be actuated by the actuating drive. The actuating drive is arranged in an injector body and the control element is arranged in a control-element housing in such a way that it can be moved in the direction of a longitudinal axis. The injector body and the control-element housing are arranged in the axial direction with respect to one another. An axial clamping force is applied to the injector body and the control-element housing, such that a part of the injector body or a part of the control-element housing which is arranged in a force flow path, formed by the axial clamping force, in the injector body and the control-element housing is permanently deformed, until a value of a representative electric variable which is determined directly or indirectly for the idle stroke of the actuating drive is in a predetermined range of values.

This has the advantage that the idle stroke of the actuating drive can be set with a high degree of accuracy. Moreover, the setting of the idle stroke can be accomplished at low cost.

In one embodiment, the electric variable representative of the idle stroke of the actuating drive is representative of a closing time of the injection valve. This has the advantage that a variable which is available during the operation of the injection valve can be used to set the idle stroke.

In another embodiment, the axial clamping force on the injector body and the control-element housing is applied at least in part by means of a clamping device formed separately from the injection valve. This has the advantage that the axial clamping force can be applied to the injector body and the control-element housing by the clamping device independently of components of the injection valve.

In another embodiment, an axial clamping force with a predetermined first value is applied to the injector body and the control-element housing by means of the clamping device separate from the injection valve. A further axial clamping force with a predetermined value is applied to the injector body and to the control-element housing by means of a clamping element of the injection valve. A base value of the electric variable representative of the idle stroke of the actuating drive is determined. A second value of the axial clamping force of the clamping device, which is dependent on the base value determined, is determined. The axial clamping force of the clamping device with the second value determined is applied to the injector body and the control-element housing. The axial clamping force of the clamping element on the injector body and the control-element housing is varied until the value of the electric variable representative of the idle stroke of the actuating drive is in the predetermined range of values. This has the advantage that different axial clamping forces of the clamping elements can be compensated for by the clamping device, e.g. in the case of clamping elements from different production batches. In this way, correct mounting of the clamping element for the accuracy of the idle stroke can be achieved. High accuracy in setting the idle stroke can thereby be achieved.

In another embodiment, after the axial clamping force of the clamping device with the second value determined is applied to the injector body and the control-element housing, the axial clamping force of the clamping element on the injector body and the control-element housing is first of all varied until the value of the electric variable representative of the idle stroke of the actuating drive is in a predetermined limiting range outside the predetermined range of values. The axial clamping force of the clamping device with the second value determined is then applied to the injector body and the control-element housing until the value of the electric variable representative of the idle stroke of the actuating drive is in the predetermined range of values. The injector body and the control-element housing are then relieved completely of the axial clamping force of the clamping device separate from the injection valve. This has the advantage that there is no subsequent flow of the injector body and/or of the control-element housing, that is to say the value of the electric variable representative of the idle stroke of the actuating drive changes very little in the predetermined range of values.

In another embodiment, the actuating drive is pre-calibrated by determining a dependence of a stroke of the actuating drive on a characteristic electric signal of the actuating drive. The range of values of the electric variable representative of the idle stroke of the actuating drive is determined as a function of the stroke of the actuating drive. The characteristic electric signal of the actuating drive is representative of the operating characteristic of the actuating drive, for example. This has the advantage that different stroke behaviors of actuating drives can be compensated for when setting the idle stroke, depending on the control signal of the actuating drive.

In another embodiment, a radial supporting force with a predetermined value is applied to the injector body and/or the control-element housing together with the axial clamping force of the clamping device separate from the injection valve, a first value of the electric variable representative of the idle stroke of the actuating drive is determined, the injector body and/or the control-element housing is/are relieved of the axial clamping force and the radial supporting force, a second value of the electric variable representative of the idle stroke of the actuating drive is determined, the range of values of the electric variable representative of the idle stroke of the actuating drive is determined as a function of the first value and of the second value, the axial clamping force of the clamping device separate from the injection valve and the radial supporting force are applied to the injector body and/or the control-element housing, and the axial clamping force of the clamping element on the injector body and the control-element housing is varied until the value of the electric variable representative of the idle stroke of the actuating drive is in the predetermined range of values. This has the advantage that individual deformations of the injector body and/or of the control-element housing due to forces acting axially and/or radially on the injection valve can be compensated for when setting the idle stroke.

Other embodiments provide an injector assembly for an injection valve, having an injector body, which has an injector-body recess, in which an actuating drive is arranged, a control-element housing, which has a control-element housing recess, in which a control element is arranged in such a way that it can be moved in the direction of a longitudinal axis. In a closed position of the control element, a fluid flow through at least one injection opening is prevented and, otherwise, a fluid flow through the injection opening is allowed. The injector body and the control-element housing are arranged in the axial direction with respect to one another. The injector body and/or the control-element housing have/has a contact section which is elevated in the axial direction. This has the advantage that the idle stroke of the actuating drive can be set in a simple manner and with a high degree of accuracy.

In another embodiment, the contact section is designed as at least one biting edge. This has the advantage that a very reliable fluidtight contact between the injector body and the control-element housing is possible.

In another embodiment, the contact section is of annular design. This has the advantage that deformation of the contact section in all radial directions is possible.

FIG. 1 shows an injection valve having an injector assembly 10 with a longitudinal axis A. The injector assembly 10 has an injector body 14 and a control-element housing 16. The control-element housing 16 is of multi-part design and has a recess 17. The recess 17 in the control-element housing 16 can be coupled to a high-pressure circuit (not shown) for the fluid. In an installed state of the injection valve, it is coupled to the high-pressure circuit. The control-element housing 16 is coupled securely to the injector body 14 by means of a clamping element 18 designed as a nozzle-clamping nut. The control-element housing 16 and the injector body 14 form a common housing of the injection valve.

The injector body 14 has a recess 20, in which an actuating drive 22 is arranged. The actuating drive 22 is designed as a stroke-action actuating drive and may be a piezoelectric actuator, which comprises a stack of piezoelectric elements. The axial extent of the piezoelectric actuator changes in accordance with an applied voltage signal. However, the actuating drive 22 can also be designed as some other actuating drive known to be suitable for this purpose by a person skilled in the art, in particular as a solenoid.

The actuating drive 22 acts on a control element 26 via a piston-shaped transmission element 24. The control element 26 comprises a bell-shaped body 28, a lever device 30 and a nozzle needle 32. The bell-shaped body 28, the lever device 30 and the nozzle needle 32 are arranged in the recess 17 of the control-element housing 16. The bell-shaped body 28 is coupled to the lever device 30. The nozzle needle 32 has a nozzle needle head 34. The lever device 30 interacts with the nozzle needle head 34 to produce an axial movement of the nozzle needle 32.

The control element 26 furthermore comprises a pin 35. The bell-shaped body 28 is coupled to the transmission element 24 of the actuating drive 22 by the pin 35.

The nozzle needle 32 is guided in one region of the recess 17 of the control-element housing 16. It is preloaded by means of a nozzle spring 36 in such a way that it prevents a fluid flow through at least one injection opening 40 arranged in a nozzle point 38 of the control-element housing 16 when there are no other forces acting on the nozzle needle 16. The nozzle spring 36 is arranged between an abutment 42 on the control-element housing 16 and a shoulder 44 on the nozzle needle 32, and is preloaded in such a way that it exerts a force acting in the closing direction on the nozzle needle 32.

Figure 2:
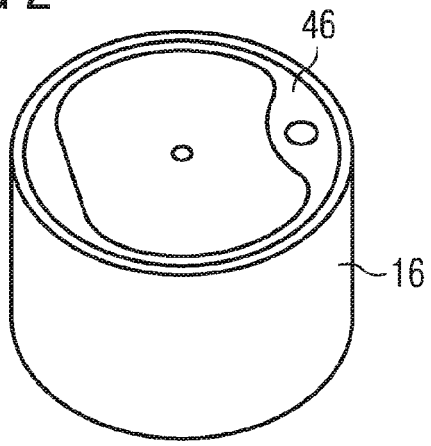
FIG. 2 shows part of the injection valve in a perspective view.

The control-element housing 16 has a contact section 46 which is elevated in the axial direction. In particular, the contact section 46 is arranged between the injector body 14 and the control-element housing 16, on an end of the control-element housing 16 facing the injector body 14. When a suitable axial clamping force is applied to the injector body 14 and the control-element housing 16, the contact section 46 plastically deforms a contact location on the injector body 14. As an alternative, an appropriate choice of material can be used to ensure that the contact section 46 is also deformed. In other embodiments, the contact section 46 can also be arranged on the injector body 14. The contact section 46 may have an annular design, thus allowing deformation of the contact section 46 around the circumference of the injector body 14 or the control-element housing 16 (FIG. 2).

The injector assembly 10 is assigned a control unit 48, which has sensors that detect various measured variables and can respectively determine the value of the measured variables.

In accordance with at least one of the measured variables, the control unit 48 determines actuating variables, which can then be converted into one or more actuating signals for controlling control elements by means of corresponding actuating drives. The control unit 48 may also be referred to as a device for setting the idle stroke of the actuating drive 22 of the injection valve.

The operation of the injection valve is explained below: activation of the actuating drive 22, which is designed as a piezoelectric actuator, causes the latter to expand. After executing an idle stroke D, the transmission element 24 strikes the pin 35, and the nozzle needle 32 is raised from the sealing seat by means of the bell-shaped body 28 and the lever device 30. As a result, the nozzle needle 32 moves in the direction of the actuating drive 22, thereby exposing the at least one injection opening 40 in the nozzle point 38. If the injection valve 10 is designed as a fuel injection valve, an injection of fuel into a combustion chamber of an internal combustion engine can now take place. As soon as the injection is to be ended, the actuating drive 22 is deactivated. As a result, the actuating drive 22 designed as a piezoelectric actuator contracts, and the nozzle needle 32 is moved away from the actuating drive 22 in the axial direction with the assistance of the nozzle spring 36. The nozzle needle 32 thus moves into a closed position, and the fluid flow through the at least one injection opening 40 is cut off.

Figure 3:
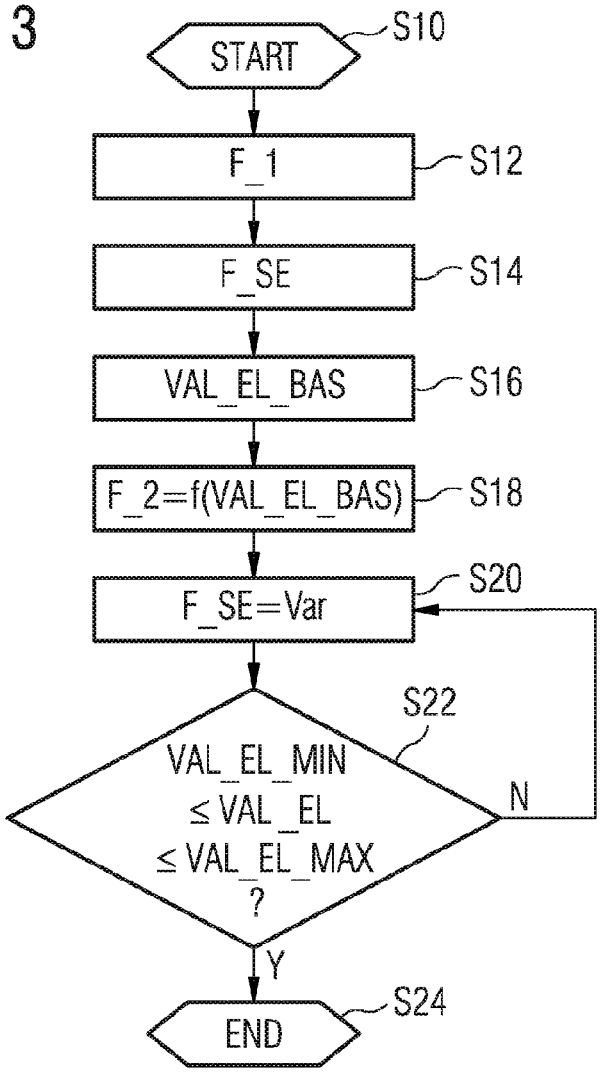
FIG. 3 shows a flow diagram of a program for setting an idle stroke of an actuating drive of the injection valve.

A first program, illustrated schematically in FIG. 3, for controlling the device for setting the idle stroke of the actuating drive of the injection valve may be stored on a storage medium of the control unit 48. The program may be started in a step S10, in which variables are initialized, if required. This may take place at the beginning of the setting of the idle stroke of the actuating drive of the injection valve. In a step S12, an axial clamping force with a predetermined first value F_1 is applied to the injector body 14 and the control-element housing 16 by means of a clamping device 50 (FIG. 1) separate from the injection valve. In a step S14, a further axial clamping force with a predetermined value F_SE is applied to the injector body 14 and the control-element housing 16 by means of the clamping element 18 of the injection valve. The application of the axial clamping forces to the injector body 14 and the control-element housing 16 causes permanent deformation in a part of the injector body 14 and/or in a part of the control-element housing 16 which is arranged in a force flow path, formed by the axial clamping force, in the injector body 14 and the control-element housing 16. In the embodiment of the injection valve shown in FIG. 1, it is, in this case, that part of the injector body 14 which faces the contact section 46 which is plastically deformed, in particular. In a step S16, a base value VAL_EL_BAS of the electric variable representative of the idle stroke D of the actuating drive 22 is determined. The electric variable representative of the idle stroke D of the actuating drive 22 may be representative of a closing time of the injection valve. The base value VAL_EL_BAS of the electric variable representative of the idle stroke D of the actuating drive 22 can be determined directly or indirectly. Indirect determination can be accomplished, for example, by means of a pressure sensor, which detects a pressure variation in the recess 17 in the control-element housing 16. In a step S18, a second value F_2 of the axial clamping force of the clamping device 50, which is dependent on the base value VAL_EL_BAS determined, is determined, and the axial clamping force of the clamping device 50 with the second value F_2 determined is applied to the injector body 14 and the control-element housing 16.

In a step S20, the value F_SE of the axial clamping force of the clamping element 18 on the injector body 14 and the control-element housing 16 is varied. In a step S22, the system checks whether a value VAL_EL of the electric variable representative of the idle stroke D of the actuating drive 22 is in a predetermined range of values with a minimum value VAL_EL_MIN and a maximum value VAL_EL_MAX. If the condition in step S22 is not satisfied, processing is continued in step S20. If the condition in step S22 is satisfied, processing is continued in a step S24. In step S24, the program is ended.

The application of the axial clamping force of the clamping device 50 as illustrated makes it possible to compensate for a variation in the axial clamping force of various clamping elements 18 due, for example, to different batches of the clamping elements 18. It is thereby possible to achieve a high degree of accuracy in the setting of the idle stroke D.

Figure 4:
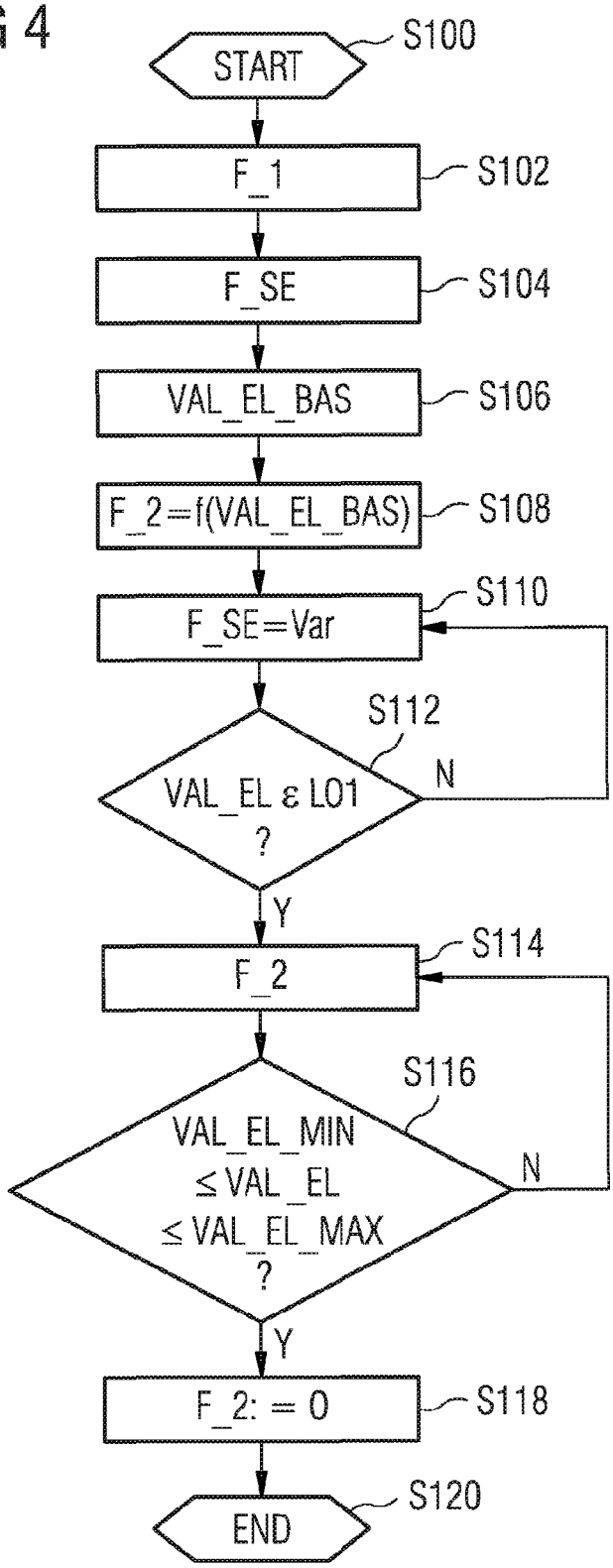
FIG. 4 shows a flow diagram of another program for setting the idle stroke of the actuating drive.

A second program for controlling the device for setting the idle stroke of the actuating drive of the injection valve is illustrated schematically in FIG. 4. The program may be started in a step S100, in which variables are initialized, if required. In a step S102, an axial clamping force with the predetermined first value F_1 is applied to the injector body 14 and the control-element housing 16 by means of the clamping device 50. In a step S104, the further axial clamping force with the predetermined value F_SE is applied to the injector body 14 and the control-element housing 16 by means of the clamping element 18 of the injection valve. In a step S106, the base value VAL_EL_BAS of the electric variable representative of the idle stroke D of the actuating drive 22 is determined. In a step S108, the second value F_2 of the axial clamping force of the clamping device 50, which is dependent on the base value VAL EL BAS determined, is determined, and the axial clamping force of the clamping device 50 with the second value F_2 is applied to the injector body 14 and the control-element housing 16. In a step S110, the value F_SE of the axial clamping force of the clamping element 18 on the injector body 14 and the control-element housing 16 is varied. In a step S112, the system checks whether the value VAL_EL of the electric variable representative of the idle stroke D of the actuating drive 22 is in a predetermined limiting range LIM outside the predetermined range of values. If the condition in step S112 is not satisfied, processing is continued in step S110. If the condition in step S112 is satisfied, processing is continued in a step S114. In step S114, the axial clamping force of the clamping device 50 with the second value F_2 determined continues to be applied to the injector body 14 and the control-element housing 16. In a step S116, the system checks whether the value VAL_EL of the electric variable representative of the idle stroke D of the actuating drive 22 is in the predetermined range of values with the minimum value VAL_EL_MIN and the maximum value VAL_EL_MAX. If the condition in step S116 is not satisfied, processing is continued in step S114. If the condition in step S116 is satisfied, processing is continued in a step S118. In step S118, the injector body and the control-element housing 16 are relieved of the axial clamping force of the clamping device 50 separate from the injection valve. In step S120, the program is ended.

If the value VAL_EL of the electric variable representative of the idle stroke D of the actuating drive 22 initially enters the predetermined limiting range LIM outside the predetermined range of values (step S112), and if the axial clamping force of the clamping device 50 with the second value F_2 then continues to be applied to the injector body 14 and the control-element housing 16 (step S114), the injector body 14 or the control-element housing 16 may still flow. This flow process may cause the value VAL_EL of the electric variable representative of the idle stroke D of the actuating drive 22 to enter the predetermined range of values with the minimum value VAL_EL_MIN and the maximum value VAL_EL_MAX. If the injector body 14 and the control-element housing 16 are then relieved completely of the axial clamping force of the clamping device 50 (step S118), the flow process stops. It is thereby possible to set the idle stroke D very accurately.

Figure 5:
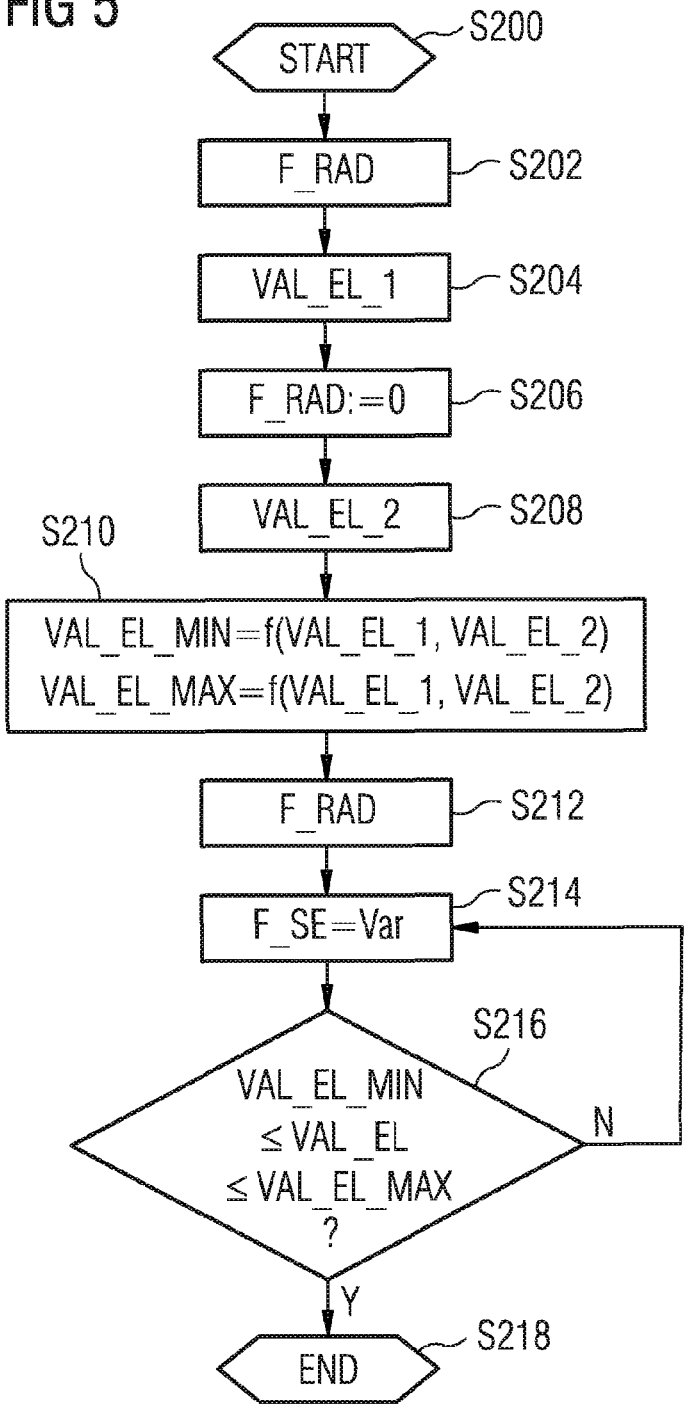
FIG. 5 shows a flow diagram of another program for setting the idle stroke of the actuating drive.

A third program for controlling the device for setting the idle stroke of the actuating drive of the injection valve is illustrated schematically in FIG. 5. The program may be started in a step S200, in which variables are initialized, if required. In a step S202, a predetermined radial supporting force with a value F_RAD together with the axial clamping force of the clamping device 50 separate from the injection valve is applied to the injector body 14 and the control-element housing 16. In a step S204, a first value VAL_EL_1 of the electric variable representative of the idle stroke D of the actuating drive 22 is determined. In a step S206, the injector body 14 and the control-element housing 16 are relieved of the radial supporting force F_RAD together with the axial clamping force of the clamping device 50 separate from the injection valve. In a step S208, a second value VAL_EL_2 of the electric variable representative of the idle stroke D of the actuating drive 22 is determined. In a step S210, the predetermined range of values of the electric variable representative of the idle stroke D of the actuating drive 22 with the minimum value VAL_EL_MIN and the maximum value VAL_EL_MAX is determined as a function of the first value VAL_EL_1 and of the second value VAL_EL_2. In a step S212, the radial supporting force with the value F_RAD together with the axial clamping force of the clamping device separate from the injection valve is applied to the injector body 14 and the control-element housing 16. In a step S214, the axial clamping force of the clamping element 18 on the injector body 14 and the control-element housing 16 is varied. In a step S216, the system checks whether the value VAL_EL of the electric variable representative of the idle stroke D of the actuating drive 22 is in the predetermined range of values with the minimum value VAL_EL_MIN and the maximum value VAL_EL_MAX. If the condition in step S216 is not satisfied, processing is continued in step S214. If the condition in step S216 is satisfied, processing is continued in a step S218, in which the program is ended. In this way, individual, non-permanent deformations of the injector body 14 and/or of the control-element housing 16 due to forces acting axially and/or radially on the injection valve can be compensated for during the setting of the idle stroke D, and the idle stroke D can be set very accurately.

Moreover, the range of values of the value VAL_EL of the electric variable representative of the idle stroke D of the actuating drive 22 can be determined according to how the stroke of the actuating drive 22 depends on a control signal of the actuating drive 22. Such a dependence of the stroke of the actuating drive 22 can thus be compensated for in a simple manner during the setting of the idle stroke D.

What is claimed is:

1. A method for setting an idle stroke of an actuating drive of an injection valve in relation to a control element actuated by the actuating drive, wherein the actuating drive is arranged in an injector body and the control element is arranged in a control-element housing such that the control element is moveable in an axial direction, and the injector body and the control-element housing are arranged in the axial direction with respect to one another, the method comprising:

applying an axial clamping force to the injector body and the control-element housing, such that a part of the injector body or a part of the control-element housing arranged in a force flow path defined by the axial clamping force is permanently deformed, and continuing to apply the axial clamping force to the injector body and the control-element housing until it is determined that a value of a representative electric variable that is determined directly or indirectly for the idle stroke of the actuating drive is within a predetermined range of values.

2. The method of claim 1, wherein the electric variable representative of the idle stroke of the actuating drive is representative of a closing time of the injection valve.

3. The method of claim 1, wherein the axial clamping force on the injector body and the control-element housing is applied at least in part by a clamping device separate from the injection valve.

4. The method of claim 3, comprising:

applying an axial clamping force with a predetermined first value to the injector body and the control-element housing by the clamping device separate from the injection valve, applying a further axial clamping force with a predetermined value to the injector body and to the control-element housing by a clamping element of the injection valve, determining a base value of the electric variable representative of the idle stroke of the actuating drive, determining a second value of the axial clamping force of the clamping device based on the determined base value, applying the axial clamping force of the clamping device with the determined second value to the injector body and the control-element housing, and varying the axial clamping force of the clamping element on the injector body and the control-element housing until the value of the electric variable representative of the idle stroke of the actuating drive is within the predetermined range of values.

5. The method of claim 4, comprising:

after applying the axial clamping force of the clamping device with the determined second value to the injector body and the control-element housing:

varying the axial clamping force of the clamping element on the injector body and the control-element housing until the value of the electric variable representative of the idle stroke of the actuating drive is within a predetermined limiting range outside the predetermined range of values, and applying the axial clamping force of the clamping device with the determined second value to the injector body and the control-element housing until the value of the electric variable representative of the idle stroke of the actuating drive is within the predetermined range of values, and relieving the injector body and the control-element housing of the axial clamping force of the clamping device separate from the injection valve.

6. The method of claim 4, comprising:

pre-calibrating the actuating drive by determining a dependence of a stroke of the actuating drive on a characteristic electric signal of the actuating drive, and determining the range of values of the electric variable representative of the idle stroke of the actuating drive as a function of the stroke of the actuating drive.

7. The method of claim 4, comprising:

applying a radial supporting force with a predetermined value to at least one of the injector body and the control-element housing together with the axial clamping force of the clamping device separate from the injection valve, determining a first value of the electric variable representative of the idle stroke of the actuating drive, relieving at least one of the injector body and the control-element housing of the axial clamping force and the radial supporting force, determining a second value of the electric variable representative of the idle stroke of the actuating drive, determining the range of values of the electric variable representative of the idle stroke of the actuating drive as a function of the first value and of the second value, applying the axial clamping force of the clamping device separate from the injection valve and the radial supporting force with the value to at least one of the injector body and the control-element housing, and varying the axial clamping force of the clamping element on the injector body and the control-element housing until the value of the electric variable representative of the idle stroke of the actuating drive is within the predetermined range of values.

* * * * *